US006432150B1

(12) United States Patent
Levashov et al.

(10) Patent No.: US 6,432,150 B1
(45) Date of Patent: Aug. 13, 2002

(54) DIAMOND-CONTAINING STRATIFIED COMPOSITE MATERIAL AND METHOD OF MANUFACTURING THE SAME

(75) Inventors: Evgeny Alexandrovich Levashov, Moscow; Alexander Sergeevich Rogatchov, Chernogolovka; Boris Vladmirovich Spitsin, Moscow, all of (RU); Mitsue Koizumi, 17-11, Modorigaoka 4-chome, Toyonaka-shi, Osaka (JP); Manshi Ohyanagi, I-505, 108-11 Minamigasa-cho, Kusatsu-shi, Shiga (JP); Satoru Hosomi, Oyama (JP)

(73) Assignees: The Ishizuka Research Institute, Ltd., Kanagawa; Mitsue Koizumi, Osaka; Manshi Ohyanagi, Shiga, all of (JP); Moscow Steel and Alloys Institute, SHS-Center, Moscow (RU)

( * ) Notice: Subject to any disclaimer, the term of this patent is extended or adjusted under 35 U.S.C. 154(b) by 0 days.

(21) Appl. No.: 09/462,889

(22) PCT Filed: Jul. 16, 1997

(86) PCT No.: PCT/JP97/02469

§ 371 (c)(1),
(2), (4) Date: May 12, 2000

(87) PCT Pub. No.: WO99/03641

PCT Pub. Date: Jan. 28, 1999

(51) Int. Cl.[7] ..... B24D 3/06; B24D 3/02; B24D 18/00

(52) U.S. Cl. ..... 51/293; 51/307; 51/309; 51/297; 164/97; 164/98; 419/10; 419/11; 419/14; 419/17

(58) Field of Search ..... 51/293, 295, 297, 51/307, 309; 164/97, 98, 284, 332, 333; 419/10, 11, 14, 17

(56) References Cited

U.S. PATENT DOCUMENTS 4,604,106 A * 8/1986 Hall et al. ..... 51/293
5,304,342 A * 4/1994 Hall, Jr. et al. ..... 51/293
5,645,617 A * 7/1997 Frushour ..... 51/309

* cited by examiner

*Primary Examiner*—Michael Marcheschi
(74) *Attorney, Agent, or Firm*—Larson & Taylor PLC

(57) ABSTRACT

A superabrasive containing layered composite is provided which comprises a substrate block consisting of either ceramic material and metallic or several metallic materials, and a superabrasive containing body adjacent said substrate block. The superabrasive contains superabrasive particles, and a metallic ingredient which is distributed in the superabrasive containing layer, including a working surface. The superabrasive material may be formed using a compression cell wherein the compression cell comprises a die defined by a vertical wall and a flat closed bottom. Placed in the die, in order from bottom upward, comprises a formed pallet of single body or layers of mixed powder forming a refractory compound, a material mass of a working layer containing diamond particles, a mass of ignition material comprising an SHS composition, and an electrical heating element.

8 Claims, 3 Drawing Sheets

DIAMOND-CONTAINING STRATIFIED COMPOSITE MATERIAL AND METHOD OF MANUFACTURING THE SAME

TECHNICAL FIELD

This invention relates to a sintered composite containing rather a high concentration of diamond particles to be used as tool blanks and in wear-resistant applications. It also relates to a method for producing such composite economically.

BACKGROUND TECHNIQUE

Metal bonded and polycrystalline types of superabrasive tools are widely employed in the industries, such that diamond or c-BN (cubic boron nitride) particles are distributed in- and bonded by means of metallic phase, or the abrasive particles are immediately joined with each other, by treating under a combined pressure-temperature condition where the superabrasive material is thermodynamically stable.

In the manufacture of such metal bonded tool blanks, it is desirable that the binder material should exhibit a high melting point in order to achieve a good hold of the abrasive particles. However, rather low melting metals with limited mechanical strength only are available for such purposes. High sintering temperatures generally inherent to such high melting metals make it almost impossible to practice the sintering by conventional techniques because the superabrasive material undergoes the unavoidable conversion to the lower pressure polymorphism phase, or graphite in the case of diamond, for example.

On the other hand, it is desirable for wear-resistant uses that the tool working-surface should contain as high a concentration as possible of superabrasive particles of excellent hardness, in order to achieve highest surface hardness available. However, since the binder content decreases with increasing abrasive contents, it becomes difficult to achieve an adequate holding of abrasive particles. Good holding by the matrix is obtained usually at an abrasive concentration, in the working surface layer, of 20 vol. % or less for diamond, for example. While such abrasive contents may be sufficient for achieving an acceptable performance with some types of tools such as wheels and blades, they are not necessarily adequate for cutting tools as well as wear-resistant parts.

On the other hand, a higher diamond concentration of, say, 95 volume % or more may be achievable in the tool working surface of polycrystalline, or immediately joined diamond particles. This technique, however, necessitates an ultrahigh pressure apparatus, which in particular has a reaction chamber of inevitably limited volume and geometry, so there are difficulties in the manufacture of large or blocky articles, in addition to the rather high costs.

Another known type comprises a layer of sintered diamond particles that are joined to the substrate of, usually, cemented tungsten carbide. This is likely to suffer from disintegration at the interface, when subjected to an intense heat during the brazing or use.

Therefore, one of the principal objects of the inventions is to eliminate the above-described problems inherent to the conventional techniques. It is another object to provide a composite product in which an increased concentration of superabrasive particles are contained in the surface layer and held adequately, without risking a separation at the interface. It is another object to provide a tool blank and a wear-resistant material, as well as a method for producing such articles.

The inventors previously developed a novel technique for producing a close structured ceramic composite material on the basis of a combined technique of SHS process and compression, which is known from WO97/11803, for example. The metallic component, which melts under the high temperature during the process, flows in and fills effectively the voids among and around the skeletal structure of in-situ formed ceramics, so a product can be now obtained with good heat-resistance and close structure.

It is known that the SHS process can yield an intense heat over a very limited duration of, say, a few seconds. We found in this relation that the heating conditions provided by SHS process causes, due to such short duration, little deterioration in the mechanical strength of diamond particles contained in the reaction composition. This can be said even when the temperature reaches 2000° C. or more, which are high enough to cause ceramics to melt or soften.

DISCLOSURE OF INVENTION

The composite of the invention essentially comprises a substrate block, which consists of either ceramic material and metallic material or several metallic materials, and a superabrasive containing body arranged in adjacency and joined to said substrate block, which contains at least 25 but not exceeding 95% by volume superabrasive particles relative to the whole body, and a metallic ingredient which is distributed in the superabrasive containing layer, including the working surface, over through the interface and into the substrate and at a concentration that varies up or down from the level at the working surface continuously and/or in steps.

Such composite can be most effectively realized by placing a first mixture of superabrasive particles and pulverized metal in adjacency with a second mixture that is so composed as to undergo a self propagating high temperature synthesis (SHS) process to yield a ceramic substance, causing to initiate the SHS process in said second mixture and thereby producing a heat such that said metal is molten at least partly to penetrate said second mixture and, thereby providing a gradient in said molten metal concentration over the both mixtures, while a pressure is applied simultaneously under said heat in order to compact the resulting structure.

PREFERRED EMBODIMENT OF INVENTION

Figure 1:
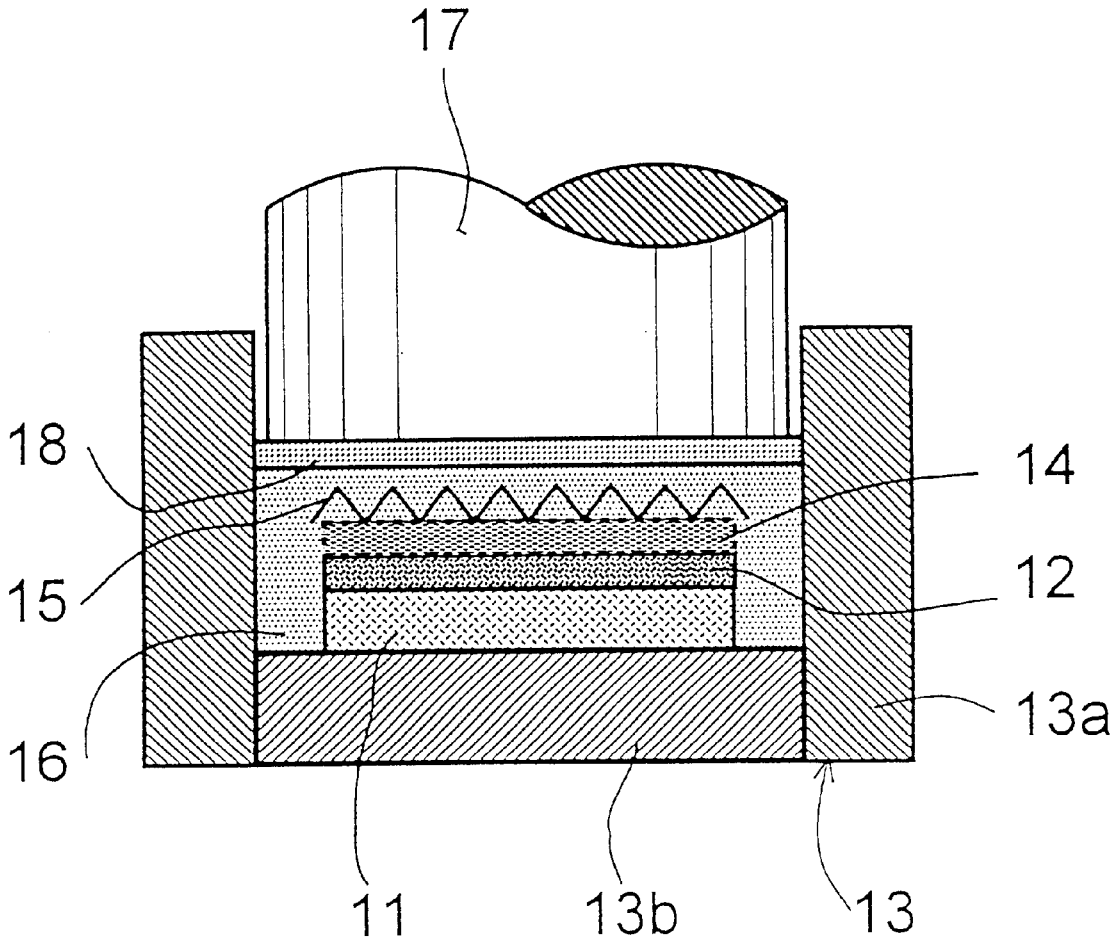
FIG. 1 shows the diagrammatic sectional illustration of the die arrangement used in example 1 described below.

In the invention the composite contains up to 95 volume % superabrasive particles, which are firmly joined with each other by means of properly distributed binder phase, and also joined as a whole to the substrate. While the concentration may be set as desired, it is suggested that the composite should contain at least 25 volume % and, preferably, 40% or more for abrasive and wear-resistant applications.

Such a high concentration of superabrasive particles in the composite can be achieved by the method of invention. This is based on the self-propagating high-temperature synthesis (SHS) and carried out under combined pressure-temperature condition where the superabrasive substance is metastable thermodynamically. The composite contains a minor proportion of bond or binder of metallic material for the superabrasive particles. It is distributed at a concentration that gradually varies, namely decreases or increases, over the way from the superabrasive layer outside surface toward the substrate, either continuously or in steps.

In the invention, the intervention of molten metal is essential to the joining of superabrasive particles to each other and as a whole to the substrate. Therefore, the SHS reaction system is composed to yield some melt of metallic binder that is contained therein as an ingredient. Here the superabrasive ingredients serve as a heat diluent, as they are commonly neutral to the SHS process and diamond, in particular, is a good conductor of heat. So it becomes difficult generally to sustain the SHS process itself at higher superabrasive concentrations in the starting material, because the heat requirement increases with the superabrasive content, as well as heat loss by dissipation through the heat conductive particles.

The above problem can be solved in the invention by limiting the superabrasive content relative to the whole reaction system, in order to allow a heat volume sufficient for the sintering to flow into the superabrasive layer. Also so-called chemical oven is available as a supplementary heat source. For example, an exothermic reaction composition without diamond content may be arranged as a substrate material in adjacency with the diamond layer. Alternatively, another exothermic reaction composition may be arranged to surround the diamond layer.

Or either or both of electroresistive heater and induction heater may be arranged either in adjacency or around the reaction composite, as another supplementary heater in addition to the chemical oven.

Another solution is to use as a binder powder of a metal that has a melting point lower than the temperature achieved with the reaction composition to be prepared. It is admixed intimately with superabrasive particles and charged to form the working layer or its equivalent, so the metal, when molten, flows among- and intermediates to firmly join the particles.

The inventors found that the latter technique is particularly effective for achieving a superabrasive particle concentration of up to 95 volume % with a rather small working layer thickness of, say 2 mm or less. During the SHS process the metal melts among- and joins the superabrasive particles each other. Then it passes to the in-situ forming substrate to fill the voids and gaps, resulting in an increase in relative superabrasive concentration of the working layer.

On the other hand, as the molten metal flows longer it gradually reduces in volume over the way from the working layer to the substrate, so there occurs at least a consistent gradient in metal concentration. This feature effectively prevents the disintegration of the both layers due to thermal stresses.

In the invention, it is practical from the view point of ready finishing that the working layer with diamond particles have a thickness of 0.1 to 1.0 mm.

The metals to be used as a superabrasive binder of the invention include cobalt and nickel metals and their based alloys that are capable of adequate holding of the particles. For diamond in particular, carbide forming metals and their alloys are preferred, so included are W, Mo and Ti metals, Co—W and Ni—W alloys. While cobalt and nickel in themselves may accelerate the unfavorable conversion of diamond to graphite at elevated temperatures, the major part of the diamond particles remain little affected, due to the extremely limited duration of the heating by the SHS process of the invention.

The working layer may contain in addition to the metallic binder, either carbide or nitride of a transition metal or aluminum oxide in minute powder as an agent for increasing the retention of superabrasive particles. It may also contain powder of C, Ni, Si, Si/C mixture or Ti, as well as substrate material compositions, as described below, which can form a compound during the SHS process.

For the substrate material compositions available are mixed powder of such elements that are capable of forming a skeletal structure of ceramics, such as carbide, nitride, boride and silicide in an SHS process. A few examples include mixed powder of a metal selected from Ti, Zr and Mo with either of C and B. The substrate ceramics to be formed by the process comprises, singly or in combination, carbide, nitride, boride and silicide of the elements of groups IVa, Va and VIa of the Periodic Table, as well as aluminum oxide. A few examples include TiB+Ti, TiB+Ni, $TiB_2$+Si, $TiB_2$+SiC, TiC+TiAl, TiC+Ni, TiN+Co, TiN+Ni, TiN+Si and TiN+SiC, as well as those listed here with the titanium ingredient partly replaced with Mo. The substrate also may be formed of alloys such as NiAl and CoAl. They may be contained in the working layer, as admixed with the superabrasive particles or the metallic binder.

Those powder materials can be handled as a formed pellet of various geometry, ranging from a simple flat plate to some blocky figures, as desired. The pellets may be prepared by CIP (cold isostatic pressing), as well as a rather simple technique of die molding.

It is effective to put some nitride or boride in a working layer composition containing c-BN or in the substrate in adjacency, for its decomposition at elevated temperatures can be substantially suppressed.

The substrate material composition undergoes an SHS process, whereby a ceramic substance is produced to consist the substrate and, at the same time, the metallic ingredients in the working layer are molten when heated, principally, by the reaction heat. While the molten metal penetrates and joins the superabrasive particles, it partly flows in the substrate, into- and fills the voids and gaps among- and around the skeletal structure of ceramics and, thereby improving the mechanical strength of the substrate. The bond between the working layer and the substrate is improved by the presence of the metal concentration gradient, which develops inwards from the working layer and substrate interface. It results as the molten metal flows in the substrate over the way from said interface while reducing in volume. The gradient is especially remarkable when the SHS process was started on the back, or at the side opposite to the interface.

On the other hand, addition of pulverized metal or metallic material to the ceramic forming composition is effective for obtaining a firm substrate, which has an improved skeletal structure with the gaps filled with molten metal. The metals available include ones of the same kinds as employed for the binder and readily alloying types.

Anyway, it is essential to the invention that all the metallic ingredients be once molten. Thus the working layer, substrate and metallic materials are all so composed and formulated as that the SHS process yield a heat volume sufficient for melting all such ingredients. Alternatively, the metallic ingredients are so selected as to melt under the heat volume expected from the SHS process. Metals of melting point less than 1600° C. in particulr are suitable. They include, besides Co and Ni described above, Cu, Ag, Zn, Cd, Al, Si, Ti, Sn, Pb, Zr, Bi, Sb, Cr and Fe metals, which may be used either singly or in combination. In particularly preferable are Co, Ni and Fe metals, exclusive alloys of- and intermetallic compounds containing those metals.

In the case of insufficient heat volume expected for melting completely the metallic ingredients, it is necessary to use simultaneously a supplementary heat source in order to secure the heat requirement. For this purpose available is another type of preliminary heater such as electroresistive wire, HF induction system as well as a chemical oven.

When the pre-mixed metallic ingredient content is less in the ceramic substrate than in the working layer, a concentration gradient occurs in the composite near the interface, such that the metallic concentration decreases over the way inward in the substrate from the interface. In contrast, when the metallic ingredient content is higher in the ceramic substrate and especially when the working layer contains no such ingredient, the gradient is that the metallic concentration decreases inward in the substrate from the substrate toward the working layer.

The substrate body may be composed of intermetallic compound, such as Ti—Ni and Ti—Co, as formed in-situ by the SHS process. Here compounds of varying compositions in steps can be formed by allowing the melt to flow principally from the working layer to the substrate. Such process of forming intermetallic compounds only produces rather a limited volume of heat. As insufficient for sustaining the process, it is often necessary to use for the supplement another heat source such as a preliminary heating system and a chemical oven.

The deterioration of diamond particles by oxygen during the SHS process can be effectively prevented as well as graphitization, by conducting the process in a reducing atmosphere. For this purpose, the material composition may be admixed with a few percent of compound, for example titanium hydride, such as yielding hydrogen during the SHS process.

The deterioration of diamond particles at elevated temperatures during the SHS process also can be prevented by another technique developed by the Inventors. The diamond particles may be coated in prior to the use, with either of Ti, Cr, Mo, W, other Groups IV, V and VI transition metals of the Periodic Table, as well as carbide, nitride and boride of such metals. The coating effectively protects the diamond during the SHS process, and at the same time improves somewhat the retention of such particles to the binder. Conventional techniques can be employed to form the coating of transition metal, such as physical and chemical vapor deposition. In the manufacture of a tool blank based on an SHS process, the metallic coating may form, under the intense heating, some compounds with the superabrasive substance or its ingredient or ingredients, at least partly. This is also useful to form a firm retention of the superabrasive particles.

It is commonly difficult to achieve a large diffusion distance of molten metal over the extremely limited duration of, typically a few seconds, of heating by the SHS process. In such case another technique is available to effectively form a concentration gradient in metallic ingredient over the way from the working layer toward the substrate. That is masses of powder mixtures are prepared at different metallic ingredient concentrations, so that the concentration is varied in steps over such masses, and arranged in advance at the interface between the working layer and substrate. In the preparation of composite working layer with an 80 volume % of diamond concentration, for example, a material composition with a 40% diamond concentration is inserted as an intermediate layer in the form of mixed loose powder or formed pellet. The remainder of the composition may comprise only the same metallic ingredient as in the working layer, or occasionally as desired, substrate material composition in addition.

In the invention the product working layer diamond concentration of 40 to 95 volume % can be achieved by starting with a material containing 20 to 70% diamond, taking into consideration the volume of molten metal to flow out from the layer.

The multi-layer composite of the invention can be obtained with the SHS product brazed to a substrate of metallic material such as steel and cemented carbide. The brazing may be effected by means of molten metal, either which is supplied from in the substrate or which forms on the surface of the support under the heat of the SHS process.

The products of the invention can take a multi-layer construction in which the working layer is either inserted between two parts of the substrate, or surrounded by the substrate, depending on the usage.

The method of the invention is based on the combined technique of SHS and compression for obtaining a composite of compact structure and good mechanical properties. The compression is started immediately after the ignition when the heating relies upon the SHS process alone, with the use as a chemical oven included. It may be started prior to the ignition when using an external heater for the supplement.

Compression may be effected by direct pressing on a die, pseudo-hot isostatic pressing by means of molding sand as a pressure medium, or roll pressing.

Each of the composite products described above may be further deposited with diamond on the surface of the diamond containing working layer, by CVD (chemical vapor deposition) or PVD (physical vapor deposition) technique, so as to form a surface substantially consisting of diamond alone. The diamond to be thus deposited can be controlled in size, crystal habit, and crystal completeness by means of process parameters, so as to produce materials, as desired, especially adapted for wear-resistant and tribologic applications.

EXAMPLE 1

(FIG. 1)

A forming die with a 20-mm diameter cylindrical cavity was used. For the material of working layer one weight part of 30–40 $\mu$m diamond powder and two parts of cobalt metal powder were mixed and filled in the die cavity to a height of about 2 mm. Then mixed titanium and boron powder of 1:2 molar ratio was laid over the diamond/cobalt mixture for the substrate material. The whole was compressed at a pressure of 50 MPa to form a circular pellet, 6 mm thick approximately.

Then as schematically shown in FIG. 1, the pellet 11 was placed, with the diamond layer 12 side up, in a 60 mm I.D reaction die 13 which consisted of a vertical wall 13*a* and a bottom 13*b*. The layer 12 was spread over by 1:1 (molar ratio) Ti/C mixed powder 14 with a graphite heater 15 thereon, for ignition. The whole was covered with molding sand 16.

Current was passed to turn on the heater 15 and initiate the SHS process. After one second of the ignition compression was begun with the piston 17, through the insulating block 18, and a pressure of 100 MPa was maintained for 15 seconds. The sintered product that resulted exhibited a diamond concentration of about 80% on the working layer surface. XMA (X-ray microanalyser) observation indicated a firm bonding of the working layer to the substrate by means of cobalt metal, which in the substrate filled the gaps among the $TiB_2$ particles.

The cobalt concentration showed a gradient in the substrate body, in which it decreased over the way in the substrate from an approx. 40% level at the interface to an approx. 10% at the opposite side.

EXAMPLE 2

A forming die with a 20-mm diameter cylindrical cavity was used. For the material of working layer one weight part of 80–100 $\mu$m diamond powder and two parts of cobalt metal powder were mixed and filled in the die cavity to a height of about 2 mm. Then mixed titanium and boron powder of 1:1 molar ratio was laid over the diamond/cobalt mixture for the substrate material. The whole was compressed at a pressure of 50 MPa to form a circular pellet, 6 mm thick approximately.

In the 60-mm I.D. reaction die cavity a 2-mm thick, 25-mm diameter steel disk was placed as a support blank and, then, the pellet with the diamond layer side up. The whole assembly was spread over by a layer of 1:1 (molar ratio) Ti/C mixed powder as a chemical oven of supplementary heat source, and a graphite heater 15 for ignition. The whole was covered with molding sand.

Current was passed to turn on the heater and initiate the SHS process. After one second of the ignition, compression was begun with the piston and a pressure of 100 MPa was maintained for 15 seconds.

The sintered product that resulted contained about 90 volume % diamond concentration of on the working layer surface. The sectional observation showed that the working layer was joined to the substrate by means of cobalt metal, while the latter and the steel support, principally with molten and re-solidified iron. The cobalt phase existed in the substrate to fill the gaps among the TiC particles, with a decreasing concentration gradient that developed inwards in the substrate from the interface.

EXAMPLE 3

A 1:1:2 (in weight ratio) mixed powder of 80–100 $\mu$m diamond, tungsten carbide and nickel was molded into a 2-mm thick circular pellet of 20-mm diameter, as a working layer material. Then a 1:1 molar ratio mixed powder of titanium and carbon was formed into a 6 mm thick circular pellet as a substrate blank. The working layer pellet was now placed in the reaction die, then laid over by the substrate. The substrate pellet was ignited on the upper side and the SHS process was conducted under the same conditions as in example 2. As a result, a layered composite was obtained with the working layer surface deposited with an about 75 volume % of diamond particles firmly held in a WC—Ni based matrix.

EXAMPLE 4

(FIG. 2)

Figure 2:
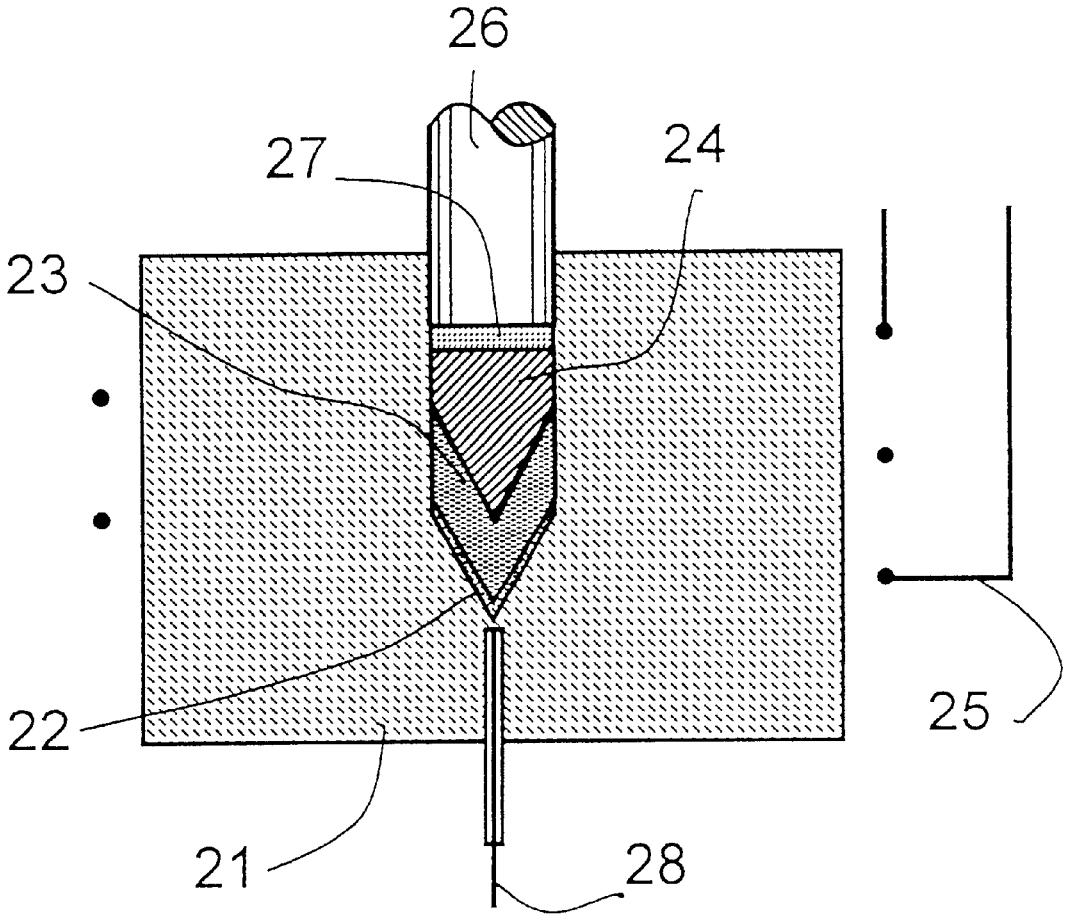
FIG. 2 shows the diagrammatic sectional illustration of the compression forming die arrangement used in example 4.
Figure 3:
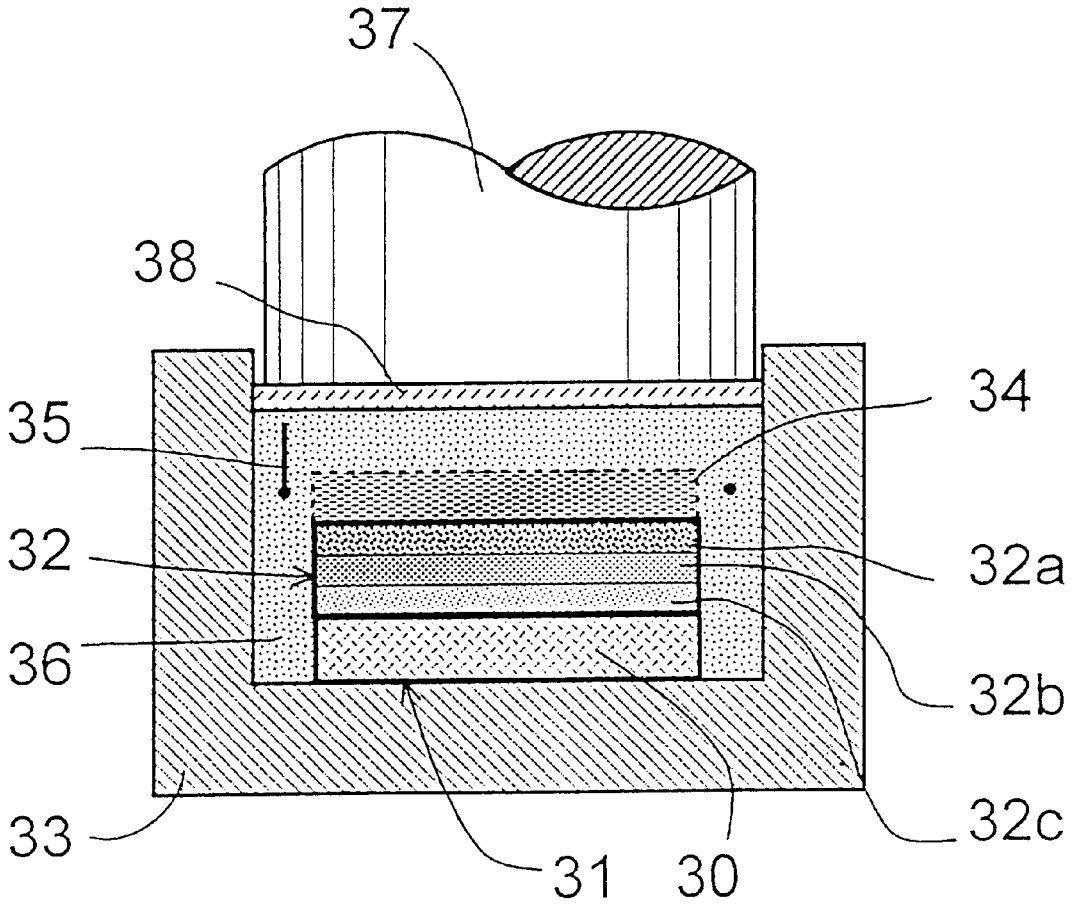
FIG. 3 shows the diagrammatic sectional illustration of the die arrangement used in example 5.

One gram of 1:2:0.06 (in weight ratio) mixed powder of 20–30 $\mu$m diamond, cobalt metal, and $TiH_2$ was prepared as a working layer material, and two grams of 1:2 (in molar ratio) mixed powder of titanium and boron, as a substrate material. For the support a conical sintered block WC-13% Co was used that had a 15 mm base diameter and an apex angle of 60°. For sintering, a mold of sintered aluminum oxide 21 was used, which had a 40 mm thick wall with a conical recess of 15 mm base diameter and 60° apex angle, as shown in FIG. 2. In this mold were placed, in consecutive layers, composed powders 22, 23 for working layer and substrate and a support blank 24, in this order upwards from bottom. Current was passed over the HF coil 25 surrounding the mold to heat the support blank 24, so that the mixed powder was ignited to initiate the SHS process. Simultaneously with the HF heating the piston 26 was driven to compress the assembly through an insulation block 27 and a pressure of 70 MPa was maintained for 10 seconds. The ignition was confirmed on a thermocouple 28, which ran to close to said recess of the mold 21. The recovered product was polished on the surface and used successfully as a lathe center.

EXAMPLE 5

(FIG. 3)

A multi-layered pellet of layered construction was prepared. The substrate material was composed of mixed powder of 70% (Ti—C: equimolar Ti and C mixture) and 30% (in weight ratio) molybdenum metal, and the diamond layer material, mixed powder of 80% (Ti—C) and 20% Co for the matrix with 40–60 $\mu$m diamond particles at varying concentrations of 3, 7 and 12 weight % on the combined basis. The mixed powders were placed in layers in a 48 mm I.D. die for forming in the order shown below, and the whole was compressed at a pressure of 20 MPa.

The charged weight of each powder and approximate thickness as formed were as follows:

| | | Charged weight | Pellet thickness as formed |
|---|---|---|---|
| Substrate material | | 25.5 | 5.0 |
| Diamond layers: | 3% | 10.0 | 2.0 |
| Diam. conc. weight | 7% | 10.0 | 2.0 |
| | 12% | 9.9 | 2.0 |

Then the sintering process was repeated under compression at same parameters and with the same arrangement as in example 1.

The pellet 31, prepared as described above, had a substrate 30 and three layers 32*a*, 32*b*, 32*c* with different diamond concentrations. It was placed in a 75-mm I.D. reaction die 33 for the process with the diamond side 32 up. Then 1:1 (in molar ratio) mixed powder of titanium and carbon 34 was spread over the diamond side 32 and further a tungsten wire heater 35 was added, the both for ignition. The whole assembly was covered with molding sand 36.

The heater 35 was turned on by passing current to initiate the SHS process; the piston 37 was driven after one second of the ignition through an insulation block 38 and a pressure of 100 Mps was maintained at 15 seconds.

The sintered product as recovered exhibited a diamond concentration of about 25 volume % on the working layer surface. The sectional observation by XMA showed that the working layers were firmly joined to the substrate by means of cobalt metal phase. The substrate, on the other hand, exhibited a continuous gradient in cobalt concentration that decreased from about 20 weight % at the interface to about 4% at the substrate base.

EXAMPLE 6

A multi-layered pellet was sintered by the same procedures as in the antecedent example. For the substrate a 4-mm thick pellet was made of equimolar Ni/Al mixed powder and formed at a pressure of 20 Mpa. For the diamond mixed matrix, a primary pellet of 48 mm diameter and 2 mm thickness pas prepared from 87% Ni–13% Al by weight mixed powder, to which added was either 5, 10, 15, 20 or 25% diamond, on the combined basis. Said matrix pellets were placed on the substrate material pellet in layers in this order upward from the bottom, and formed into a secondary pellet.

Then the secondary pellet was sintered under compression in the 75 mm I.D. die, as in the above, by means of molding sand as a pressure medium. First the pellet was surrounded by equimolar (1:1 in molar ratio) Ti/C mixed powder for the chemical oven. A tungsten wire heater was arranged outside and around said oven; current was passed over said wire to heat and ignite the oven material. After one second of the ignition compression was begun a pressure of 40 Mpa was maintained for 20 seconds. The resulting block, which contained about 60 volume % of diamond on the working layer surface, was successfully employed as a cutter edge for wood machining.

EXAMPLE 7

A multi-layer sintered product of cobalt with diamond on a TiC and cobalt substrate was prepared. Pre-composed mixed powder of Ti, C and Co, which gave a ratio of 80% TiC+20% Co, was formed into a circular pellet of 40 mm diameter and 6 mm thickness, for the substrate material.

Another mixed powder of Ti, C and Co was prepared to give a ratio of 50% TiC+50% Co for providing a working layer matrix in which diamond particles are to be held. The working layer material was prepared by admixing said mixture with diamond powder of 20-$\mu$m average particle size at a 1:1 volume ratio. 4 grams of such material and then the above pellets were charged in the bottom of a cylindrical reaction vessel of rolled graphite sheet, and subjected to the SHS process.

The sintered product as recovered exhibited a continuous gradient in which the cobalt concentration in the substrate gradually decreased from about 50% at the interface towards the bottom.

EXAMPLE 8

As a substrate material 56 grams of such pre-mixed powder of Ti, C and Co was placed in a die for forming as to give a ratio of 80% TiC and 20% Co, as in example 7. Then a mixture of 13 grams of cobalt powder and 3 grams of diamond powder of 20 $\mu$m average particle size was charged; the whole was pressed at 20 MPa into a circular pellet of 48 mm diameter.

The pellet was relocated in a reaction vessel as in example 7 for conducting the SHS process. Compression was started two seconds after the ignition, and a pressure of 30 MPa was maintained for 10 seconds. The product exhibited a working surface diamond concentration of 90 volume %, and effectively employed as a cutting tool for abrading FRPs (fiber-reinforced plastics) through wire cutting and polishing processes.

EXAMPLE 9

Mixed powder of example 8 was used for the substrate material, while such a pre-mixed powder of Ti, C and Co was used as to give a 30% TiC and 70% Co ratio for composing the matrix for holding diamond particles. 2 grams of the substrate material was first placed in the cylindrical die cavity of 16-mm diameter, where, then, came 1.5 grams of mixture of 1:1 volume ratio of 20-$\mu$m average particle size diamond powder and such pre-mixed powder. The whole was formed into a pellet under compression at 50 MPa. The pellet was arranged on a 3-mm thick support blank of steel disk of 16-mm diameter, with the diamond side out and subjected to the SHS process.

The recovered product showed a concentration gradient in which the Fe decreased while the Co increased over the way in the substrate from the support toward the working surface end.

EXAMPLE 10

Powders were composed as below and mixed intimately in a ball mill. Here the diamond concentration of each diamond layer material is indicated in weight percentage on the combined basis.

| No. | Type of material | Composition | Weight | Layer thickness as formed |
|---|---|---|---|---|
| 1 | Substrate | Ti—C—Mo | 25.5 g | 5 mm |
| 2 | Diamond layer 1 | Co + 12% 30–40 $\mu$m diamond | 10.0 g | 2 mm |
| 3 | Diamond layer 2 | Co + 25% 30–40 $\mu$m diamond | 9.9 g | 2 mm |

The mixed powder was each formed in the forming die under compression at 20 MPa into a disk pellet of 48 mm diameter and, then placed in layers in the cylindrical reaction die of a 100 mm I.D. 1:1 molar ratio mixed powder of Ti and C was arranged in adjacency around the pellets as an ignition lead, with the rest filled with molding sand. The pellets were ignited on the vertical side to initiate the SHS process, which was monitored by means of a temperature indicator at the pellet bottom center. Compression was started while the pellets were red hot, and a pressure of 200 MPa was maintained for 15 seconds.

EXAMPLE 11

56 grams of mixed powder of 64% Ti, 16% C and 20% Co by weight ratio was charged in the 48 mm I.D. cylindrical cavity of a forming die for the substrate and stamped lightly. Then a working layer material was spread over flat atop, which consisted of 13 grams of mixed powder of 20% of 30–40 $\mu$m diamond by weight and rest of cobalt on the combined basis. The whole was compressed at 20 MPa to form a pellet.

Then the SHS process was conducted as in example 10. When observed under microscope, the resulting product, as recovered and polished on the surface, showed a surface full of diamond particles at about 90 volume % which were held firmly by the sintered matrix, with a lot of them exposed.

EXAMPLE 12

A forming die was used which had a cylindrical cavity of 22 mm I.D. and pellets were formed using substrate and working layer materials of various compositions, as listed below. The percentage values in the table are such that by weight on the combined basis, unless otherwise specified. Weight data are also given in parentheses for the ingredients. Such pellets were placed in layers on a steel support blank of 22-mm diameter and 2.3 mm thickness, and subjected to the SHS process. The diamond particles were of 30–40 $\mu$m size; a chemical oven was employed for the SHS process. A pressure of 100 MPa was maintained for 30 seconds for each run.

| Run no. | Substrate material | weight | Working layer material | weight |
|---|---|---|---|---|
| 1 | TiC | 2.0 g | (TiC-40% Ni)-50 mol. % diamond (Ti 2.91 g, C 0.73 g, Ni 2.42 g, Diam. 1.94 g) Layer surface diam. Conc. about 50 vol % | 8.0 g |
| 2 | TiC-10% Ni (Ti 1.01 g, C 0.25 g, Ni 0.14 g) | 1.4 g | (TiC-40% Ni)-50 mol. % diamond (Ti 0.47 g, C 0.12 g, Ni 0.39 g, Diam. 0.32 g) | 1.3 g |
| 3 | TiC-20% ni (Ti 2.56 g, C 0.64 g, Ni 0.8 g) | 4.0 g | (TiC-40% Ni)-50 mol. % diamond (Ti 2.91 g, C 0.73 g, Ni 2.42 g, Diam. 1.94 g) | 8.0 g |
| 4 | TiC-20% Co (Ti 2.56 g, C 0.64 g, Ni 0.8 g) | 4.0 g | Co 1.5 g + Diamond 2.0 g Layer surface diam. conc. about 80 vol % | (3.5 g) |

EXAMPLE 13

The multi-layered product with the layer of cobalt and diamond, prepared in run no. 4 of the antecedent example, was treated with $HCl/HNO_3$ mixed acid to remove cobalt on the surface. It was then deposited on the surface with diamond film by CVD from $H_2$ gas admixed with 2 vol. % $CH_4$, at a filament temperature of 2100° C., a substrate temperature of 850° C. and a chamber pressure of 4000 Pa. A 3-$\mu$m thick film, approx. of polycrystalline diamond was obtained at the end of a 5-hour process.

EXAMPLE 14

A 48% Ti, 12% C and 40% Co (by weight) mixed powder was used as a substrate material. 6 grams of such powder was placed in the 16 mm diameter cylindrical cavity of the forming die after a 2 mm thick nickel plate used as a support blank, and lightly stamped. Then 3 grams of working layer material was placed flat thereon that consisted of a mixed powder of Ti and C, admixed with 40 weight % of 30–40 $\mu$m diamond powder, and formed into a pellet under compression at 20 MPa.

A mullite insulating plate was laid on the bottom of the reaction die, laid over by a graphite sheet as a heater, 1-mm thick magnesia sheet and, then, the pellet with the support side down; the rest of the die cavity was filled with molding sand. Current was passed over the graphite sheet to heat the nickel plate and initiate the SHS process.

The product was recovered, polished on the surface and observed microscopically. The surface zone contained a high concentration of diamond particles, which were firmly held in the sintered matrix, at an approximately 90 volume % on the surface; a lot of them were visible from outside. The analysis on a section indicated a nickel concentration that decreased continuously over the way from the substrate end to the working layer surface.

Further the working layer surface was subjected to a CVD process as in the antecedent example and a continuous, 4-$\mu$m thick diamond film was obtained.

APPILICAILITY IN INDUSTRY

The superabrasive containing layered composite of the invention is useful for uses in the polishing and cutting applications and as a wear-resistant material for the construction of various products.

What is claimed is:

1. A compression cell for producing a diamond containing layered mass, said compression cell comprising:

a die having a cavity defined by a vertical wall and a flat closed bottom, and having disposed therein, in order from bottom upwards:

a formed pellet of a single body or layers of mixed powder comprising a refractory compound, a material mass of a working layer containing diamond particles, a mass of ignition material comprising an SHS composition, and an electrical heating element, said pellet, material mass, ignition material and heating element all being embedded in a sand, over which an insulation block is disposed.

2. The compression cell as claimed in claim 1, wherein said material mass comprises layers of several formed blocks with different concentrations of diamond particles.

3. The compression cell as claimed in claim 1, wherein said cavity is cylindrical.

4. The compression cell as claimed in claim 1, wherein said die comprises separately formed bottom and vertical walls that are detachably integrated with one another.

5. A compression cell for producing a diamond containing layered mass, said compression cell comprising:

a mold of sintered refractory material, said mold comprising a conical cavity having a tapered bottom and having disposed therein, in order from bottom upwards:

a material mass of a working layer comprising diamond particles, a formed refractory substrate material, and a support member in conical construction;

and further comprising an HF induction coil arranged so as to be disposed outside said mold.

6. A compression cell for producing a diamond containing layered mass, said compression cell comprising:

a die having a cylindrical cavity closed at the bottom, and having disposed therein, in order from bottom upwards, the following layers:

a layer of substrate material mass in the form of a first mixed powder selected from the group consisting of TiC and metallic binder;

Ti metal, carbon and metallic binder; and a press-formed powder thereof;

a second mixed powder of diamond particles and pulverized metallic binder, with or without a proportion of TiC; whereby the concentration of metallic binder is higher in said substrate material mass than in said second mixed powder;

an ignition mixed powder of Ti metal and C; and an electrical heater element adjacent said substrate material mass, said cylindrical cavity being embedded in molding sand and covered with an insulation block.

7. The compression cell as claimed in claim 6, wherein said metallic binder comprises a metal selected from the group consisting of cobalt, nickel and tungsten.

8. The compression cell as claimed in claim 6, wherein said ignition powder is laid around said substrate material mass.

* * * * *